United States Patent [19]

Ohminato

[11] 4,168,920

[45] Sep. 25, 1979

[54] BINDER

[75] Inventor: Kiyoshi Ohminato, Tokyo, Japan

[73] Assignee: King Jim Co., Ltd., Japan

[21] Appl. No.: 870,124

[22] Filed: Jan. 17, 1978

Related U.S. Application Data

[63] Continuation of Ser. No. 728,030, Sep. 30, 1976, abandoned, which is a continuation of Ser. No. 547,707, Feb. 6, 1975, abandoned.

[30] Foreign Application Priority Data

| | | | |
|---|---|---|---|
| Feb. 13, 1974 | [JP] | Japan | 49-16761 |
| Feb. 13, 1974 | [JP] | Japan | 49-16877 |
| Feb. 13, 1974 | [JP] | Japan | 49-16878 |
| Feb. 13, 1974 | [JP] | Japan | 49-16879 |
| Feb. 13, 1974 | [JP] | Japan | 49-16880 |
| Feb. 13, 1974 | [JP] | Japan | 49-16881 |
| Oct. 3, 1974 | [JP] | Japan | 49-118882 |
| Oct. 5, 1974 | [JP] | Japan | 49-119846 |

[51] Int. Cl.[2] ..... B42F 13/30

[52] U.S. Cl. ..... 402/46; 402/47; 402/48

[58] Field of Search ..... 402/29, 30, 34, 36, 402/42, 45–48

[56] References Cited

U.S. PATENT DOCUMENTS

| | | | |
|---|---|---|---|
| 755,380 | 3/1904 | Montgomery | 402/48 |
| 2,057,514 | 10/1936 | Darson et al. | 402/46 |
| 2,120,659 | 6/1938 | Wedge | 402/46 |
| 2,142,786 | 1/1939 | Haskin | 402/36 X |
| 2,162,594 | 6/1939 | Vaughan | 402/46 |
| 2,200,460 | 5/1940 | Ungee et al. | 402/47 |
| 2,253,039 | 8/1941 | Lewis | 402/47 |
| 2,543,865 | 3/1951 | Danfil | 402/46 |
| 2,915,068 | 2/1959 | Miyamoto | 402/45 |
| 3,879,142 | 4/1975 | Takimoto | 402/45 X |

FOREIGN PATENT DOCUMENTS

| | | | |
|---|---|---|---|
| 503023 | 7/1930 | Fed. Rep. of Germany | 402/29 |
| 929482 | 6/1963 | United Kingdom | 402/29 |

*Primary Examiner*—Robert L. Spicer, Jr.

*Attorney, Agent, or Firm*—Robert E. Burns; Emmanuel J. Lobato; Bruce L. Adams

[57] ABSTRACT

Binder construction suited for filing papers, publications, letters and catalogues having a base member to be fixed to the inside back of a file cover and holders and their related parts intended to hold such papers and detachably mounted to the base member in such an arrangement as to be opened to desired cover side or sides of the binder construction.

2 Claims, 30 Drawing Figures

BINDER

This is a continuation, of application Ser. No. 728,030, filed Sept. 30, 1976, which is also a continuation application of Ser. No. 547,707, filed Feb. 6, 1975, both now abandoned.

BACKGROUND OF THE INVENTION

The present invention relates to an improved binder, more particularly relates to a binder construction use for filing papers, publications, letters and catalogues and can be opened on desired cover side or sides.

In the construction of most conventional binders for filing papers, the holders provided with pipes and rods for holding papers, can be opened on one cover side on the base member only and, because of such a construction, it is quite inconvenient with the conventional paper binders to the users to extract or bind papers positioned relatively remote from the cover side which can be opened. In other words, one needs to extract most of papers bound in the holders in order to take out a sheet of paper bound in the holders at a position remote from the cover side which can be opened or in order to insert a sheet of paper in such a position of the paper file.

SUMMARY OF THE INVENTION

It is the principal object of the present invention to provide a binder for filing papers with which extraction and insertion of a paper or papers can be done very easily at any desired position of the paper file.

It is another object of the present invention to provide a binder for papers of an improved construction which can be opened to any desired cover side.

It is a further object of the present invention to provide a binder for papers of an improved construction which can be very easily manufactured.

In order to attain the above-described objects, the improved binder of the present invention includes holders and their related parts adapted for holding papers and detachably mounted to the base member fixed to the cover back in such an arrangement as to open desired cover side or sides of the binder construction.

A binder according to the invention comprises a rigid base plate having two, laterally spaced, symmetrical, opposed, upstanding sidewalls symmetrically disposed rigidly thereon along the length of opposed edges, two coactive holders for jointly holding publications, letters, catalogues and the like symmetrically disposed relative to the base plate. One holder extends in a direction corresponding to an axial direction of a corresponding sidewall and has elongated pins axially spaced thereon. The other holder extends in a direction corresponding to an axial direction of a corresponding other sidewall and has elongated tubular pins provided with axial bores for receiving axially therein corresponding ones of the first-mentioned elongated pins.

Pivots cooperative with a corresponding one of the sidewalls and relative thereto pivotally and removably mount the holders independently for pivotal movement relative to a corresponding sidewall. This allows alternatively pivoting of either holder and removal alternatively thereof from the corresponding sidewall and the pivot for opening and closing the binder.

BRIEF DESCRIPTION OF THE DRAWINGS

The invention will be explained in more detail in the following description, reference being made to the embodiments shown in the accompanying drawings, in which;

FIGS. 10A through 10C are respectively perspective and transverse cross sectional plan views of further embodiment of the present invention, in which the holders are given in the form of plates of a double-walls construction.

DESCRIPTION OF THE PREFERRED EMBODIMENTS

Figure 1A:
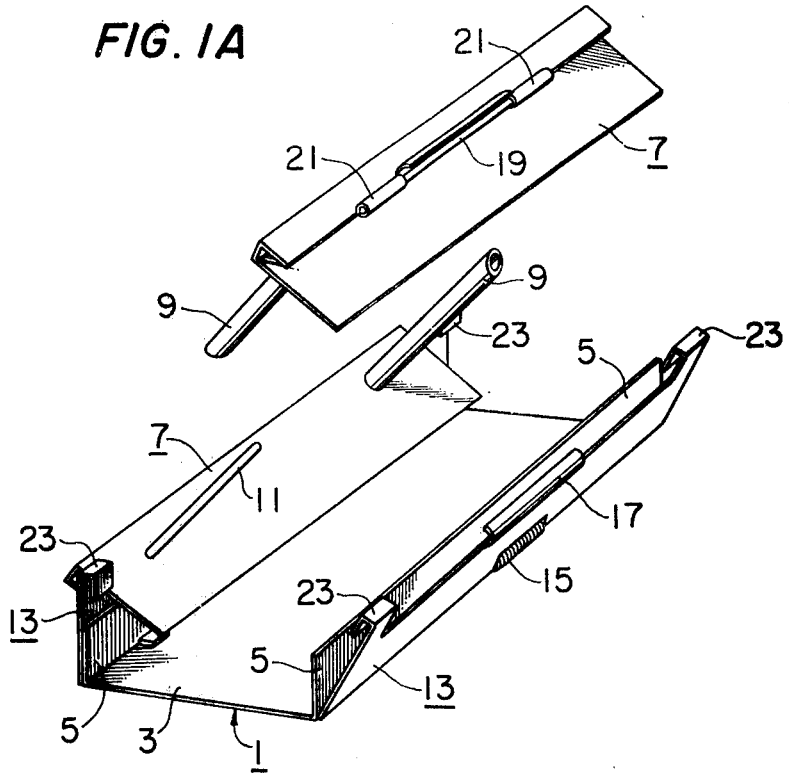
FIGS. 1A and 1B are respectively a perspective and transverse cross sectional plan view of an embodiment of the present invention.

It should be noted that, in the following description, like reference numerals refer to elements of essentially like function and construction throughout.

Figure 1B:
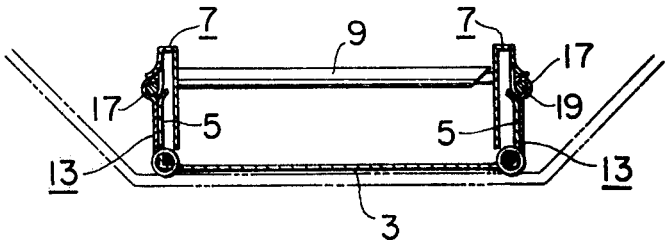

A basic embodiment of the present invention is shown in FIGS. 1A and 1B, in which a base member or plate 1 is comprised of a rigid flat bottom plate 3 and a pair of rigid side plates or sidewalls 5 connected to both edges of the bottom plate 3 substantially at right angle. Each of the side plates 5 is accompanied with a holder 7 which is, in the case of this embodiment, in the form of a C-shaped bent plate. One or more sets of holder sleeves or tubular pins 9 project almost perpendicularly from the surface of one of the holders 7 which confronts the equivalent surface of the other of the holders 7. A corresponding number of holder pins or rods 11 as the tubular pins 9 project almost perpendiculary from the surface of the other of the holders 7 which confronts the above-described surface of the one of the holders 7. The holder tubular pins 9 and rods or rigid pins 11 should be so arranged on the associated holder surfaces that a holder 9 on one holder surface corresponds to a holder rod 11 on the other holder surface and, in the state to bind papers, the latter is received and accommodated within the former.

Although the holder sleeves 9 and holder rods 11 can be arranged alternately in the lengthwise direction of a common holder surface, it is employable also that one of the holder surfaces is provided with holder 9 only whereas the other of the holder surfaces is provided with tubular pins holder rods 11 only as long as the above-described requirement is satisfied.

Each of the base member side plates 5 is accompanied on its outer side with an auxiliary plate 13 which is hinged via a spring 15 at its bottom fringe to the junction between the corresponding side and bottom plates 3 and 5 of the base member 1 in such a manner that the same is spring-loaded for a tight pressure contact with the outer surface of the associated side plate 5.

A part of the upper fringe of the auxiliary plate 13 is formed into a hooking seat 17 of a substantially semi-circular transverse cross sectional profile opening towards the inside of the binder. In correspondence to this, the outer bent fringe of the associated holder 7 is provided with a hooking rod 19 which is intended to come into engagement with the hooking seat 17 of the associated auxiliary plate 13. The hooking rod 19 is at its ends provided with stops 21 in order to prevent longitudinal disengagement between the two elements 17 and 19.

Finger pieces 23 are formed on the upper edges of the auxiliary plates 13, by which the auxiliary plates 13 can be opened apart from, the associated side plates 5 by manually overcoming the force of the spring 15.

The paper binder of the present invention having the above-described constructional features is used in the following manner.

In a state a binding of papers, the binder is kept in the disposition shown with solid lines in FIG. 1B, in which the auxiliary plates 13 are in tight pressure contact with the associated side plates 5 of the base member 1 and the holder rods 11 are accommodated within the associated holder pipes 9, the latter passing through punched holes of the paper to be bound in (not shown).

The binder can be opened to one side by pushing the finger pieces 23 of the auxiliary plate 13 on that side outwardly against the force by the spring 15. In this one side open state, the hooking rod 19 of the holder 7 is disengaged from the associated hooking seat 17 and the holder 7 is connected to the base member 1 via the holder 7 of the other side only. Then the one side holder 7 can easily be disconnected from the base member 1 by cancelling the engagement between the holder pipes 9 and holder rods 11.

When the binder is to be closed again, the above-mentioned engagement is re-established by inserting the holder rods 11 into the corresponding holder pipes 9 and pushing the holder 7 towards the corresponding side plate 5 of the base member 1 until the engagement between the hooking seat 17 of the auxiliary plate 13 and the hooking rod 19 of the holder 7 is established again.

When it is desired to open the binder to the other side, the finger pieces 23 of the auxiliary plate 13 on that side are pushed outwardly against the force by the spring 15. Then, just like in the foregoing case, the hooking rod 19 of the holder 7 is disengaged from the associated hooking seat 17 and the holder 7 is connected to the base member 1 via the holder 7 of the one side only. Further, the holder 7 on that side can be disassembled from the base member 1 also by pushing the finger pieces 23 of the auxiliary plate 13 on that side outwardly against the force by the spring 15 in order to cancel the engagement between the hooking seat 17 of the auxiliary plate 13 and the hooking rod 19 of the holder 7.

Figure 2A:
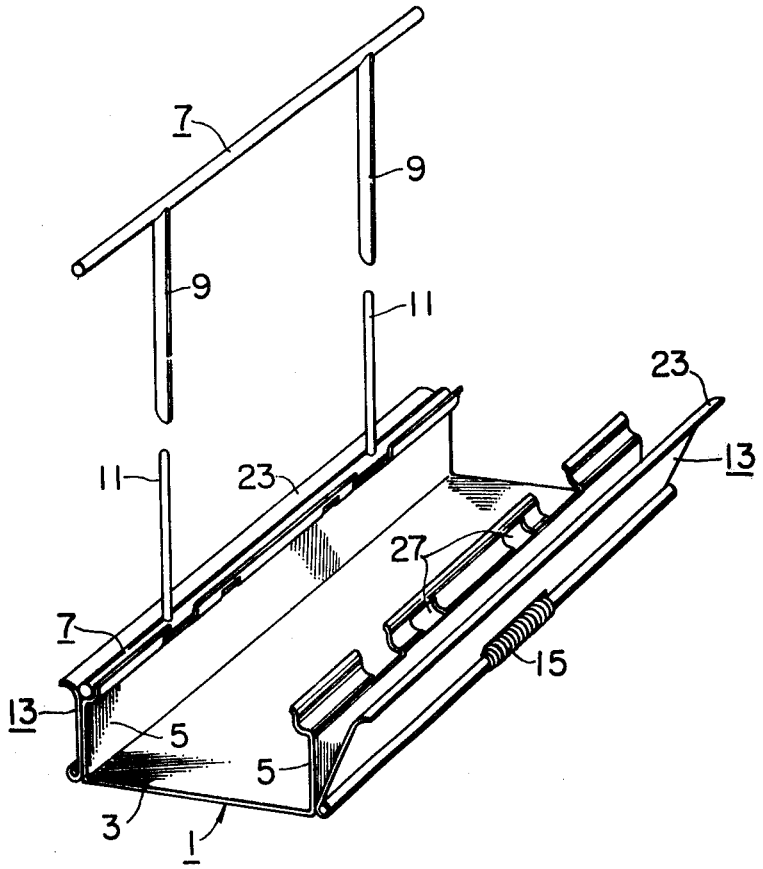
FIGS. 2A and 2B are respectively perspective and transverse cross sectional plan views of another embodiment of the present invention.
Figure 2B:
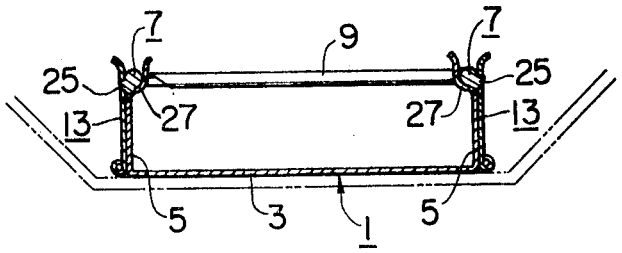

A modification of the embodiment according to FIGS. 1A and 1B is shown in FIGS. 2A and 2B, in which each holder 7 is in the form of a round rod provided with holder tubular pins 9 and/or holder rods 11 which extend substantially at right angle to the axial direction thereof and the upper edges of the side plate 5 and the associated auxiliary plate 13 is so shaped as to provide a seat for the rod-shaped holder 7 in the closed state of the binder.

As is well seen in FIG. 2B, the holder 7 in this embodiment is provided with one or more elongated peripheral projections 25 which, in the closed state of the auxiliary plate 13, are received in hooking cut-outs 27 formed in the upper edges of the base member side plate 5 and of the corresponding auxiliary plate 13 so that the both plates 5 and 13 are keyed to each other. The upper edges of the auxiliary plates 13 are at least partly bent outwardly so as to provide elements equivalent to the hand pieces 23 used in the foregoing embodiment.

Closing and opening of the binder can be carried out in a manner substantially similar to those in the preceding embodiment.

Figure 3A:
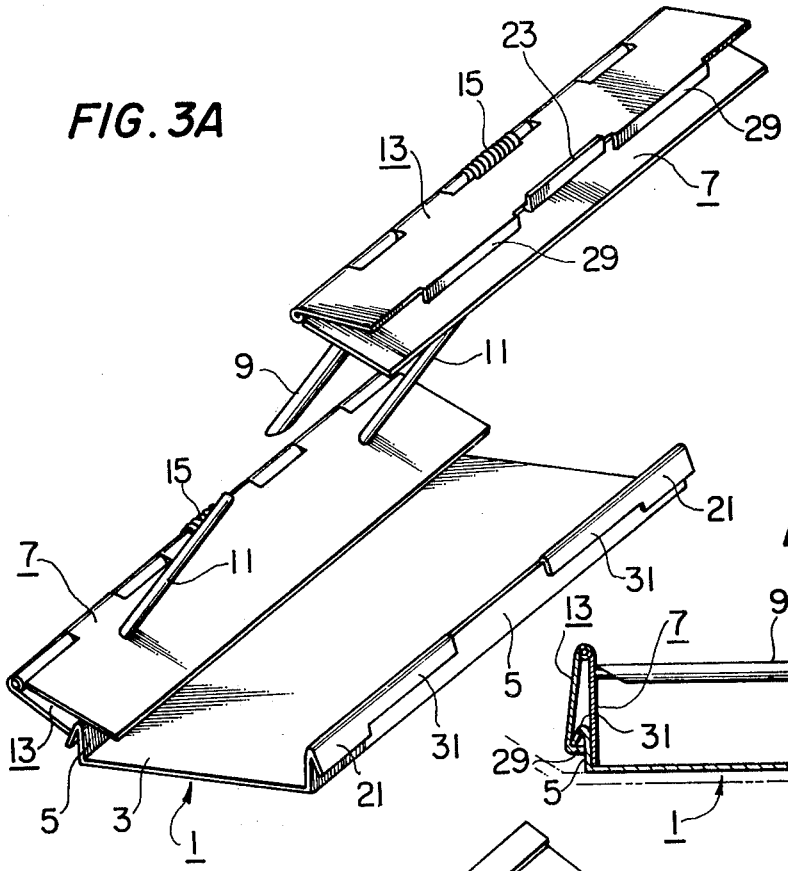
FIGS. 3A and 3B are respectively perspective and transverse cross sectional plan views of a further embodiment of the present invention.
Figure 3B:
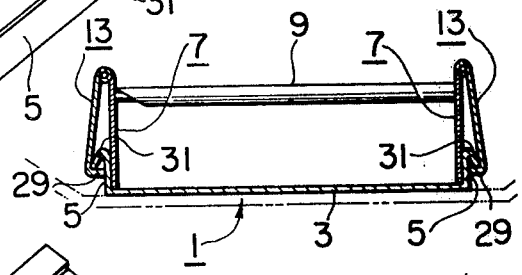

A still modified embodiment of the present invention is shown in FIGS. 3A and 3B, in which the auxiliary plates 13 are coupled not to the associated side plates 5 of the base member 1 but to the associated holders 7 which are, in the present embodiment, in the form of flat plates. That is, each auxiliary plate 13 is hinged at its upper edge via a spring 15 to the corresponding upper edge of a holder 7. Like the embodiment shown in FIGS. 1A and 1B, the holder 7 is provided with holder tubular pins 9 and/or holder pins or rods 11.

The auxiliary plate 13 is provided at its lower edge with inwardly bent hooking tongues 29 and an outwardly bent finger piece 23 whereas the upper edge of the base member side plate 3 is folded outwardly and downwardly in order to form hooking tongues 31 and stops 21 which function almost similarly to those used in the embodiment shown in FIGS. 1A and 1B.

In order to open the binder with this construction, the finger piece or pieces 23 of one auxiliary plate 13, for example, is pushed outwardly in order to disengage the tongues 29 of the auxiliary plate 13 from the tongues 31 of the associated base member side plate 5, thereby the plates 7 and 13 is rendered free of engagement with the side plate 5. Next, by pulling the plates 7 and 13 away from those on the other side, the holder tubular pins pipes 9 and holder rods 11 are disconnected from each other and the entire assembly on that side can be fully separated from the entire assembly on the other side and the base plate or member 1.

In order to reassemble and close the binder, the holder tubular pins 9 are inserted over the corresponding rigid holder pins or rods 11 and the assembly, that was once separated, is pushed down via the finger piece or pieces 23 until the tongues 29 of the auxiliary plate 13 come in engagement with the corresponding tongues 31 of the main body side plate 5 on that side.

Figure 4A:
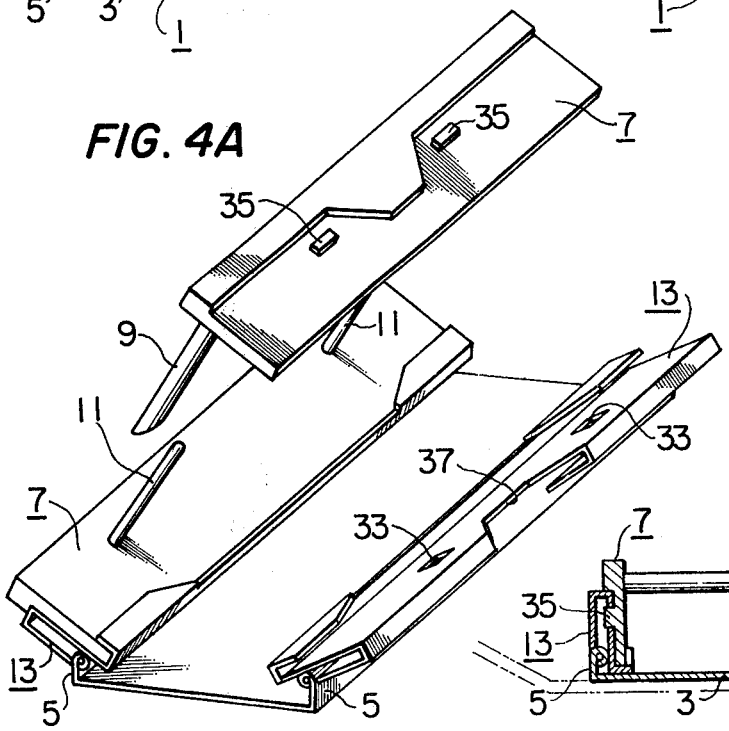
FIGS. 4A and 4B are respectively perspective and transverse cross sectional plan views of a further embodiment of the present invention.
Figure 4B:
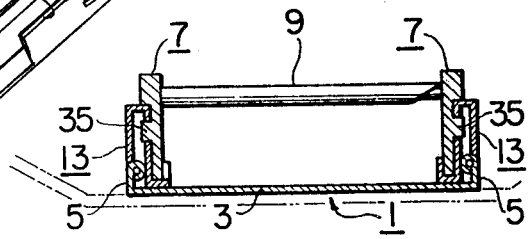

The embodiment shown in FIGS. 4A and 4B includes holders 7 which in the form of flat plates made of a synthetic resinous material, and auxiliary plates 13 of a triple walls construction. As is well seen in FIG. 4B, the auxiliary plate 13 in this embodiment has a substantially S-shaped cross sectional profile, the outermost wall thereof is hinged at its lower edge to the upper edge of the corresponding side plate 5 of the base member 1. The middle wall of the auxiliary plate 13 is provided with one or more hooking holes 33 and, in correspondence to this, the holder 7 is provided with similar number of hooking projections 35 formed on its outer surface. In the combined disposition partly shown in the drawings, the holder 7 is received on its lower side in a gap between the innermost and the middle walls of the associated auxiliary plate 13 and the hooking projections 35 thereof are in resilient tight engagement with the corresponding hooking holes 33 of the middle wall of the auxiliary plate 13. In addition, cut-outs 37 are formed in the outermost and the middle walls of the auxiliary plate 13 so as to give access to the holder 7 from outside.

In order to open the binder, a user can have access to the holders 7 through the cut-outs 37 of the auxiliary plates 13 and the holders 7 can be disengaged from their associated auxiliary plates 13 by pushing the same inwardly by hand.

Figure 5A:
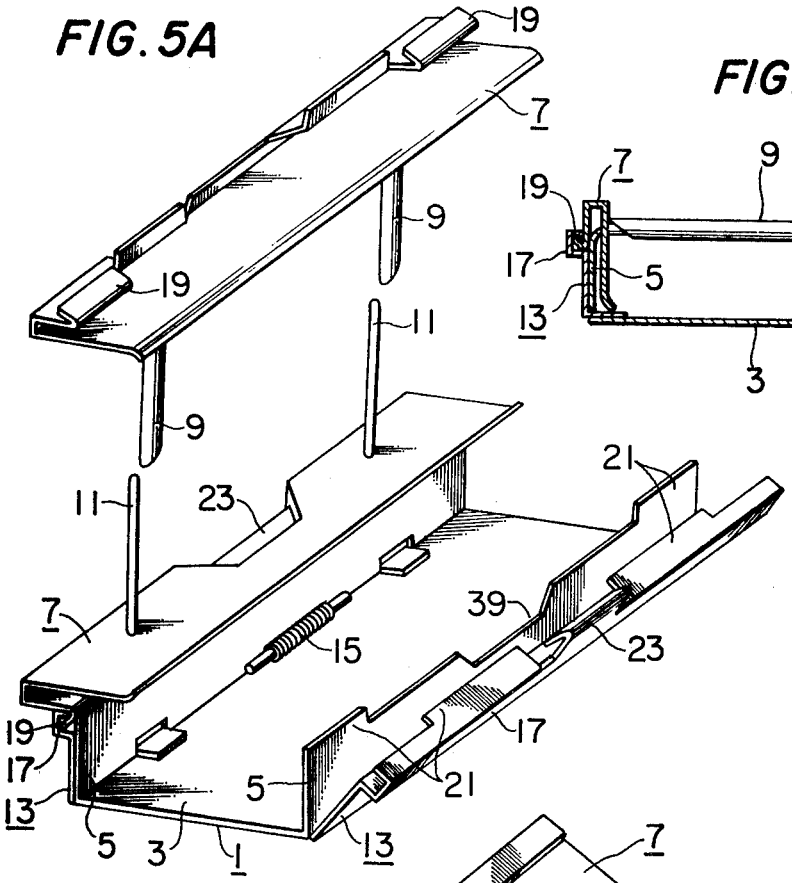
FIGS. 5A and 5B are respectively perspective and transverse cross sectional plan views of a further embodiment of the present invention.
Figure 5B:
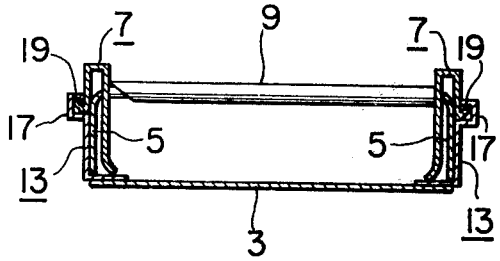

A modification of the embodiment according to FIGS. 1A and 1B is shown in FIGS. 5A and 5B, in which the side plates 5 of the base member 1 are each provided with a cut-out 39 formed in the upper fringe thereof at a position corresponding to the finger piece 23 of the associated auxiliary plate 13. Owing to the provision of such cut-outs 39, the auxiliary plates 13 can be very easily opened outwardly.

Figure 6A:
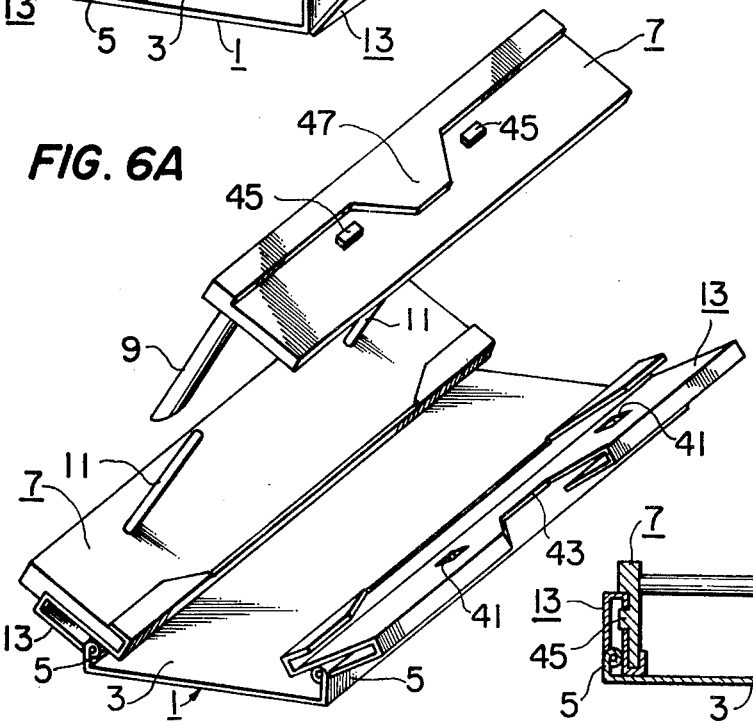
FIGS. 6A and 6B are respectively perspective and transverse cross sectional plan views of a further embodiment of the present invention, in which the holders are in the form of plates made of a flexible material.
Figure 6B:
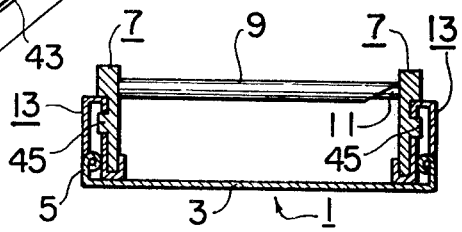

A further modified embodiment of the present invention is shown in FIGS. 6A and 6B. In the case of this embodiment, each of the holders 7 is in the form of a flat plate made up of a synthetic resin of flexible nature whereas each of the auxiliary plates 13 is provided with a triple wall construction. As is well seen in FIG. 6B, the auxiliary plate 13 is hinged at the lower edge of its outermost wall to the upper edge of the associated side wall 51 of the base member 1 and its innermost and middle walls form a gap for accommodation of the lower part of the holder 7. The auxiliary plate 13 is further provided with hooking holes 41 formed in the middle wall thereof and a cut-out 43 formed in the middle and outermost walls thereof. In accordance with this, the holder 7 is provided on its outer surface with hooking saliences 45 at positions corresponding to those of the hooking holes 41 and a heap 47 at a position corresponding to that of the cut-out 43 of the associated auxiliary plate 13, respectively.

In the closed state of the binder shown in FIG. 6B, the holder 7 is held in the gap between the innermost and middle walls of the auxiliary plate 7 with its hooking projections 45 being in a hooking engagement with the corresponding hooking holes 41 and its heap 47 resting in the cut-out 43 of the associated auxiliary plate 13, respectively.

In order to open the binder on one side, the tab 47 of the holder 7 on that side is pushed inwardly by hand through the cut-out 43 of the auxiliary plate 13 in order to make the holder 7 bent resiliently, thereby the hooking engagement of the holder saliences 45 with the auxiliary plate holes 41 is released and the holder 7 is detached from its associated auxiliary plate 13 and the base member side plate 5. After the separation, the holder 7 can be turned upwardly about the hinged axis between the auxiliary plate 13 and the base member side plate 5 on the other side. In this upwardly turned disposition, the holder 7 can now be separated as shown in FIG. 6A from the other holder 7 by pulling same upwardly. At the time of this separation, the bound papers may be wholly or partly removed from the binder together with the holder 7 to be removed or the bound papers may be wholly left on the binder being held by the holder 7 still in engagement with the base member 1. When required, the remaining side holder 7 may be removed from its associated side plate 5 in the same manner.

Provided that only one side holder 7 is open, i.e. the holder 7 is separated from the base member, closing thereof is practiced by, in the first place, combining the holder 7 (the open side holder 7) with the remaining side holder 7 (closed side holder 7) via coupling between the tubular 9 and rods 11, turning the holder 7 so combined about the hinged axis of the closed side auxiliary plate 13 and depressing the holder 7 so turned against the open side, auxiliary plate 13, thereby the holder saliences 45 are forcedly brought into hooking engagement with the corresponding auxiliary plate holes 41 due to the flexible nature of the holder 7.

Figure 7A:
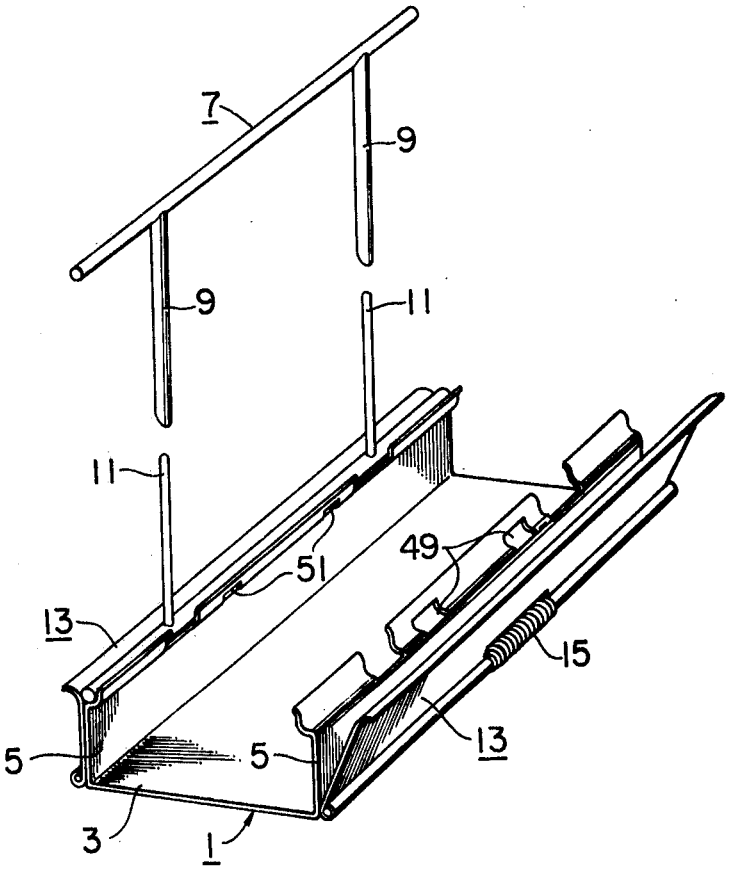
FIGS. 7A and 7B are respectively perspective and transverse cross sectional plan views of a further embodiment of the present invention, in which the holders are given in the form of rods.
Figure 7B:
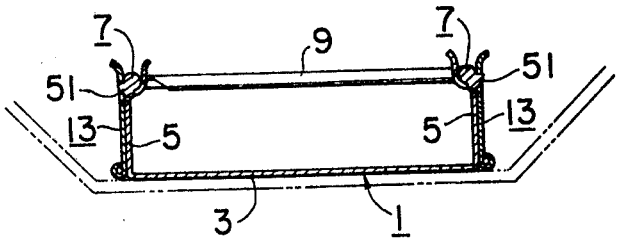

A further embodiment of the present invention is shown in FIGS. 7A and 7B, in which each of the holders 7 is in the form of a rod. The auxiliary plate 13 in this embodiment is hinged at its lower edge to the bottom corner of the base member 1 through the intermidiary of a spring 15. The upper edges of the associated base member side plate 5 and the auxiliary plate 13 are bent away from each other in order to provide a seat for the rod-shaped holder 7 in the closed state. In the bent fringe area, the base member side plate 5 and the auxiliary plate 13 are provided with hooking holes 49 and, in accordance with this, the rod-shaped holder 7 is provided with peripheral projections 51 at positions corresponding to those of the hooking holes 49 of the side plate 5 and the auxiliary plate 13 so that, in the closed state of the binder, the former should be in hooking engagement with the latter in order to lock the closed disposition of the binder.

In order to open the binder on one side, the upper outwardly bent fringe of the auxiliary plate 13 on that side is pushed outwardly against the spring force and the rod-shaped holder 7 is pushed upwardly, thereby the holder 7 is released from the hooking engagement with the open side plates 5 and 13 through the intermediary of the hooking projections 51 and the hooking holes 49. Next the open side holder 7 is turned upwardly with the closed side holder 7 about the hinged axis of the closed side auxiliary plate 13 and, by pulling the open side holder 7 upwardly, the same can be fully separated from the binder construction.

In order to close the binder, the above-described operation steps are carried out in a reverse order. Further, by pushing the upper fringe of the closed side auxiliary plate 13 outwardly and pushing the closed side holder 7 upwardly away from the closed side plate 5, the binder can be opened on the other side also.

Figure 8A:
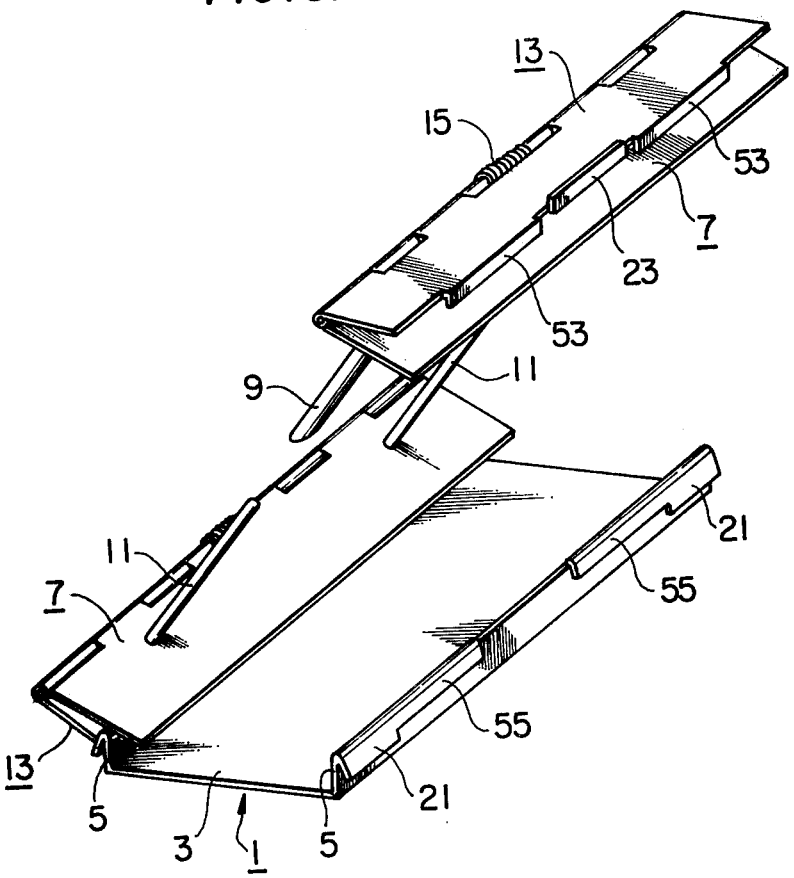
FIGS. 8A and 8B are respectively perspective and transverse cross sectional plan views of a further embodiment of the presant invention, in which the holders are provided at the upper fringes thereof with hinges.
Figure 8B:
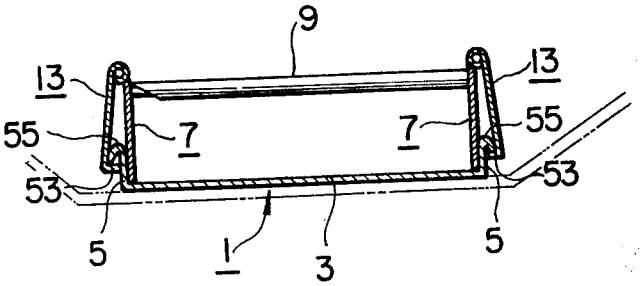

A still further embodiment of the present invention is shown in FIGS. 8A and 8B. In the case of this embodiment, the auxiliary plates 13 are connected not to the side plates 5 of the base number 1 but directly to the holders 7 which are, in this embodiment, given in the form of flat plates. That is, each auxiliary plate 13 is hinged at its upper edge to the upper edge of the associated plate-shaped holder 7 via a spring 15. The spring 15 assists the auxiliary plate 13 to be urged towards the holder 7. The auxiliary plate 13 is provided at its lower edge with one or more inwardly bent hooking tongues 53 and an outwardly bent finger piece 23. In accordance with this, the side plate 5 is provided at its upper edge, with a corresponding number of outwardly bent hooking tongues 55 and stops 21.

In the closed disposition of the binder shown in FIG. 8B, the outer surface of the holder 7 is kept in a tight pressure contact with the inner surface of the associated side plate 5 and the hooking tongues 53 of the auxiliary plate 13 are kept in a tight meshing engagement with the hooking tongues 55 of the side plate 5, both owing to the repulsion by the spring 15 disposed to the hinge between the auxiliary plate 13 and the holder 7.

When the auxiliary plate 13 on one side is opened outwardly via its finger piece 23, the meshing engagement between the hooking tongues 53 and 55 cancelled so that the auxiliary plate 13 and the associated holder 7 are decoupled from the base member side plate 5 on that side, i.e. the binder is open on one side. Next, by pulling them together away from the holder 7 on the closed side, they can be fully removed from the binder construction. The binder can be opened on the other side in a similar manner too.

Figure 9A:
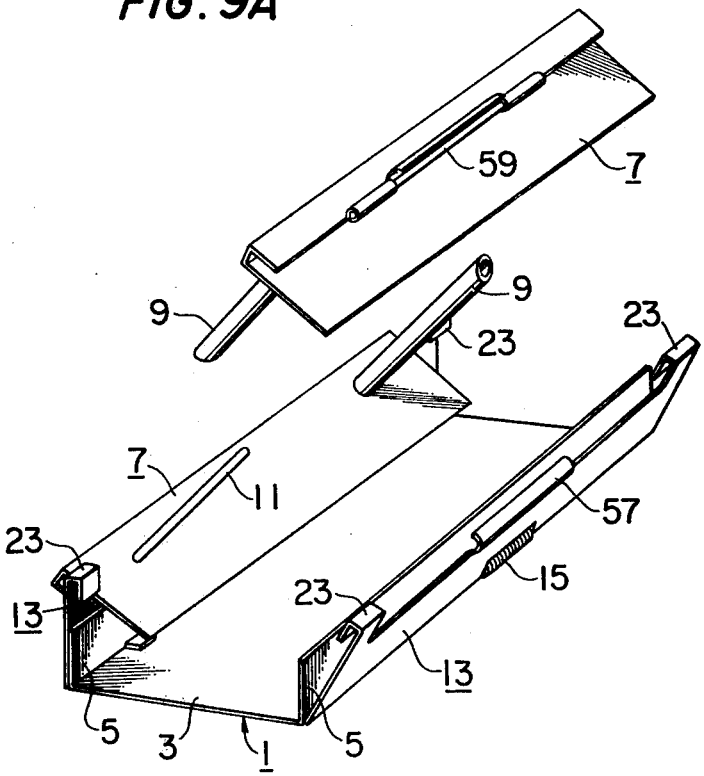
FIGS. 9A and 9B are respectively perspective and transverse cross sectional plan views of a further embodiment of the present invention, in which the holders are in the form of plates of a double-walls construction.
Figure 9B:
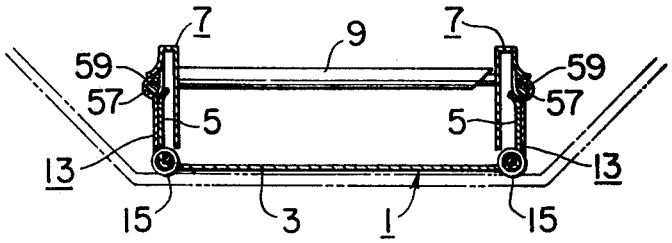

A further embodiment of the present invention is shown in FIGS. 9A and 9B, in which the holders 7 are again given in the form of flat plates. The auxiliary plate 13 in the embodiment is hinged at its lower fringe to the bottom corner of the base member 1 via a spring 15, by which the plate 13 is always kept in a tight pressure contact with the outer surface of the side plate 5. The auxiliary plate 13 is provided at its upper edge with a semi-tubular hooking seat 57 and finger pieces 23. The holder 7 has a double walls construction and is provided at the lower edge of its outer wall with a hooking rod 59 which is intended to engage with the hooking seat 57 of the auxiliary plate 13 in the closed state.

In order to open the binder on one side, the auxiliary plate 13 on that side is pushed outwardly via the finger pieces 23 and, thereby, the holder 7 can be freely removed out of the position. Further operations can be carried out in a manner similar to those employed in the foregoing embodiments.

Figure 10A:
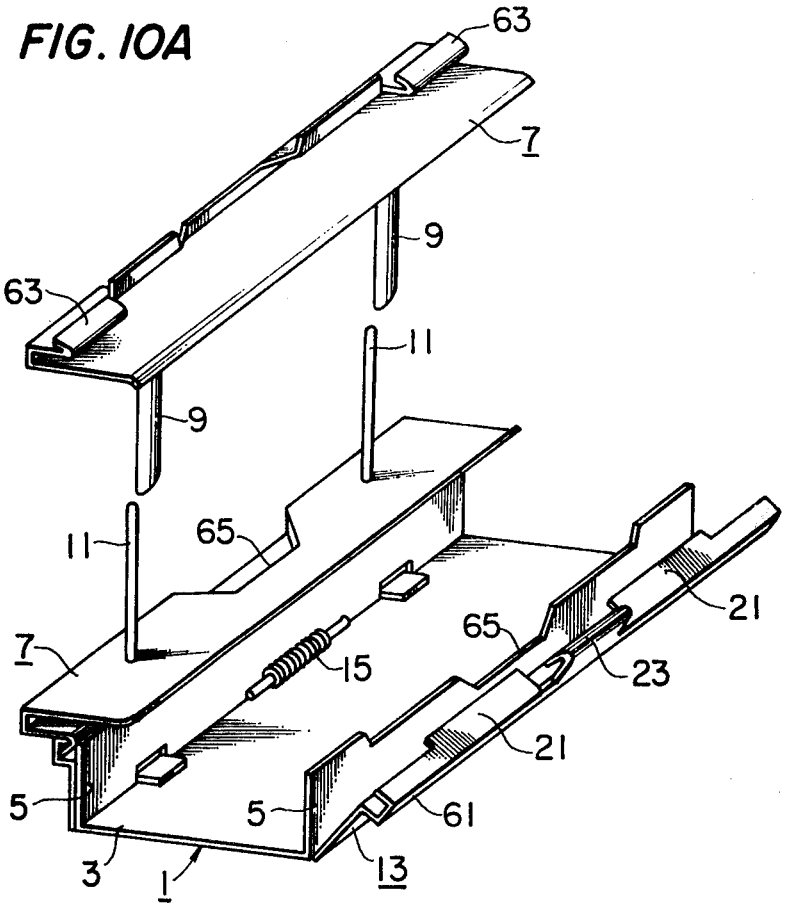
Figure 10B:
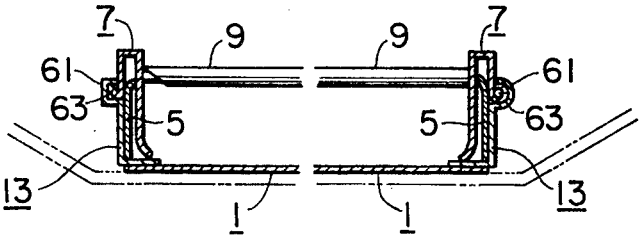

A further embodiment of the present invention is shown in FIGS. 10A through 10C, in which the holders 7 are in the form of double-walls plate constructions. The auxiliary plate 13 in this embodiment is hinged at its lower edge to the lower corner of the base member 1 via a spring 15, by which the plate 15 is always kept in a tight pressure contact with the outer surface of the associated side plate 51 of the base member 1. The auxiliary plate 13 is provided at its upper edge with hooking seats 61, stoppers 21 and a finger piece 23. The hooking seat 61 may be provided with a semi-circular transverse cross sectional profile such as shown in FIG. 10B or an angled C-shaped transverse cross sectional profile such as shown in FIG. 10C.

In accordance with the above-described construction of the auxiliary plate 13, the holder 7 is provided, at positions of the lower fringe of its outer wall corresponding to the hooking seats 61 of the associated auxiliary plate 13, with hooking tongues 63 bent outwardly and upwardly. Further, the associated side plate 5 of the base member 1 is provided, at a position corresponding to the finger piece 23 of the auxiliary plate 13, with a cut-out 65 for an easier finger access to the finger piece 23 from inside. Opening and closing of the binder are carried out in a manner substantially similar to those in the foregoing embodiments.

Figure 11A:
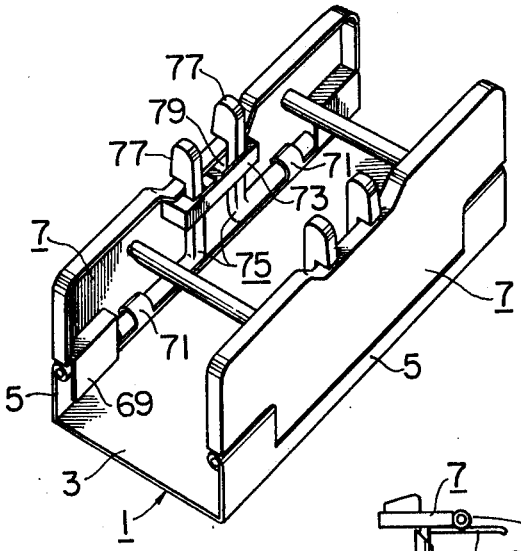
FIGS. 11A through 11D are respectively perspective and transverse cross sectional plan views of a further embodiment of the present invention, in which the detachably coupling means is given in the form of L-shaped rods.
Figure 11B:
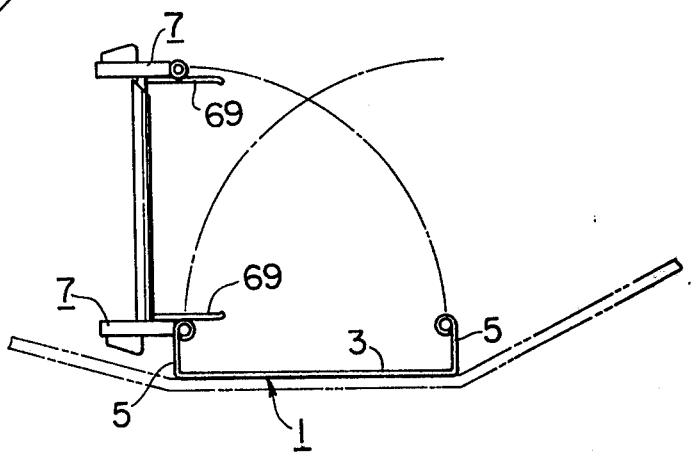
Figure 11C:
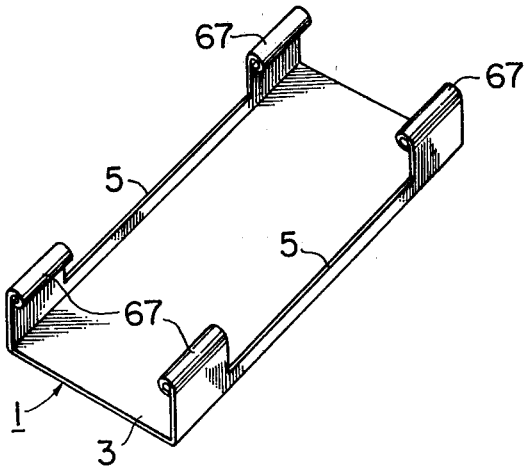
Figure 11D:
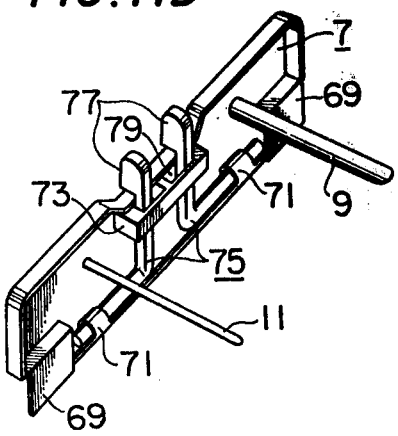

A still further embodiment of the present invention is shown in FIGS. 11A through 11D, in which the holder 7 is in the form of a substantially flat plate. The base member 1 is provided with four bearing parts 67 formed at longitudinal ends of the side plates 5 as shown in FIG. 11C. As shown in detail in FIG. 11C, the holder 7 is provided on both ends of its lower edge with inwardly stepped skirt plates 69 which, when the holder 7 is combined to the base member 1, rests on the corresponding bearing parts 67 of the side plate 5. The holder 7 is further provided at its lower edge with inwardly rounded bearing parts 71 and in the middle area of its upper edge with a guide part 73 having vertical apertures. Two sets of L-shaped rods 75 are attached to one holder 7, each of which has a nipping piece 77 formed in the upper end of its vertical branch and accommodated within the aperture of the guide part 73 of the holder 7 and a horizontal branch received in the bearing part 71 of the holder 7 in an axially turnable and longitudinally slidable state. The pair of nipping pieces 77 are urged apart from each other in the apertures of the guide part 73 by a spring 79 inserted between them.

In the closed disposition of the binder, the holder 7 is joined to the corresponding side plate 5 of the base member 1 through accommodation of the ends of the horizontal branches of the L-shaped rods 75 within the corresponding bearing parts 67 (see FIG. 11C) of the side plate 5. This engagement is retained by the repulsion of the spring 79 inserted between the nipping pieces 77 of the rods 75.

The above-described engagement is cancelled when the pieces 77 are nipped together by fingers against the spring force, thereby the holder 7 and its related parts being detached from the side plate 5 with which they were combined. Next, by pulling the holder 7 and its related parts away from the other side holder 7, they are fully removed from the binder construction. Opening of the binder on the other side can be practiced in a same way.

Figure 12A:
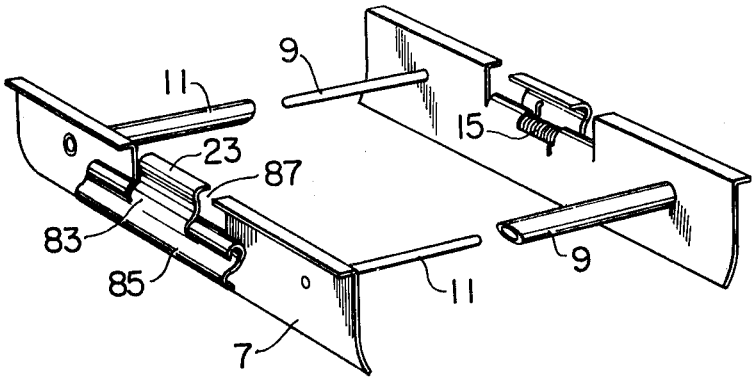
FIGS. 12A through 12C are perspective plan views of a further embodiment of the present invention.
Figure 12B:
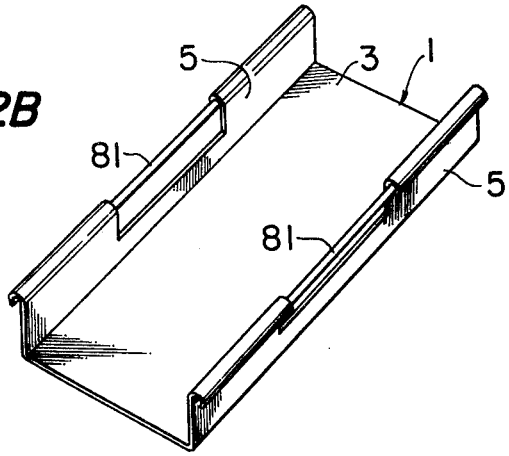
Figure 12C:
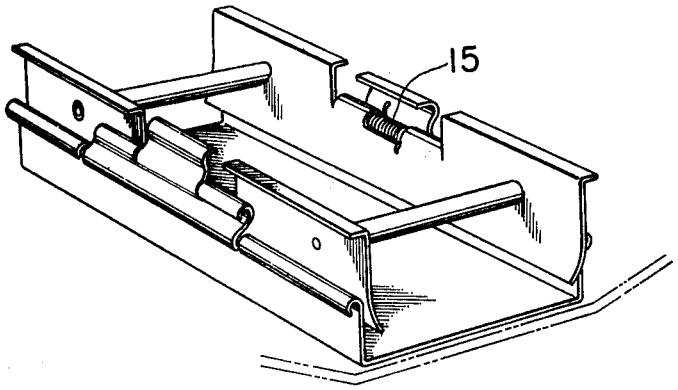

A still further embodiment of the present invention is shown in FIGS. 12A through 12C, in which the holders 7 are in the form of substantially flat plates too. As shown in FIG. 12B, the base member or plate 1 is provided with a pair of supporting shafts 81 disposed and hold on the upper edges of its side plates 5. As shown in FIG. 12A, the holder 7 is accompanied about at the middle portion of its outer surface by a clip or tab 83 whose lower edge is formed into a hooking seat 85 of a semi-circular transverse cross sectional profile and which is hinged at its upper fringe to the bottom fringe of a cut-out 87 formed in the holder 7 through the intermediary of a spring 15. This spring 15 urges the hooking seat 85 to turn towards the outer surface of the holder 7. The clip 83 is further provided with an upper projection forming a finger piece 23.

In the closed disposition of the binder shown in FIG. 12C, the holder 7 is kept in a tight pressure contact with the inner surface of the side wall 5 whereas the hooking seat 85 of the tab 83 tightly engages with the supporting shaft 81 of the side wall 5 due to the force by the spring 15, thereby the holder 7 and the unit body 83 being firmly attached to the base member 1.

For opening of the binder on one side, the finger piece 23 of the unit body 83 on that side is pushed inwardly, thereby the hooking seat 85 being disengaged from the supporting shaft 81 against the repulsion by the spring 15. While keeping this disposition, the holder 7 is turned upwardly about the hinged axis of the closed side holder 7 and the holder 7 and its related parts can be fully detached from the side wall 5 of the one side.

Figure 13A:
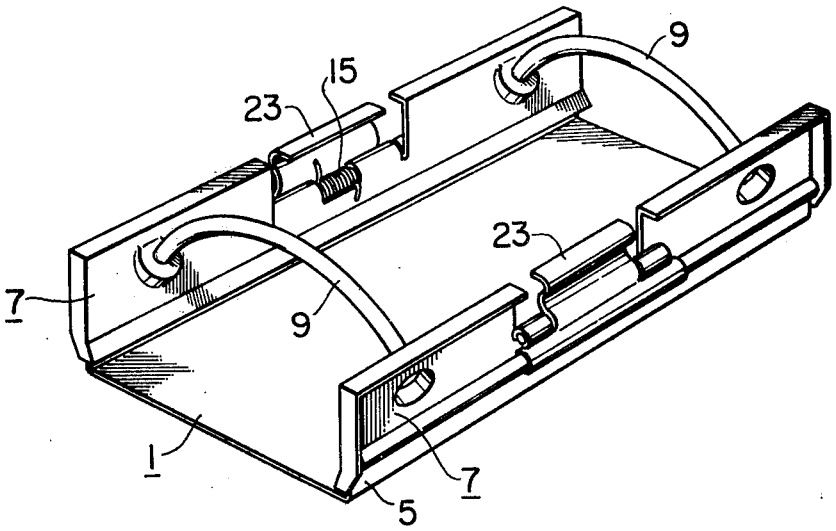
FIGS. 13A and 13B are perspective and transverse cross sectional plan views of a modification of the embodiment shown in FIGS. 12A through 12C.
Figure 13B:
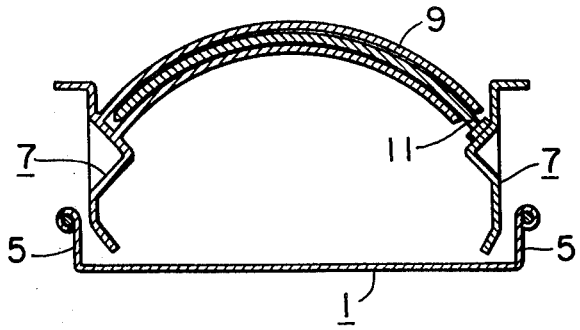

Referring to FIGS. 13A and 13B, a slight modification of the embodiment shown in FIGS. 12A through 12C is illustrated, in which the holder tubular pins 9 and the holder rods 11 are both formed in upwardly arched shapes in such an arrangement that the rods 11 can be smoothly received in the corresponding tubular pins 9 when the binder is closed.

What is claimed is:

1. A binder for filing papers, publications, letters, catalogues and the like comprising, a rigid, elongate base plate having two laterally spaced, symmetrical, opposed, upstanding sidewalls, symmetrically disposed rigidly thereon along the length of opposed, longitudinal edges and integral therewith, said sidewalls being rigidly fixed substantially at right angles to the plane of the base plate, two, symmetrical, coactive elongate holders for jointly holding publications, letters, catalogues and the like and symmetrically disposed relative to the base plate and to the sidewalls, one holder extending in a direction corresponding to an axial direction of a corresponding sidewall and having elongated pins extending substantially normal to the holder and axially spaced thereon, the other holder extending in a direction corresponding to an axial direction of a corresponding other sidewall and having elongated tubular pins extending substantially normal to said other holder and having axial bores for receiving axially therein corresponding ones of the first-mentioned elongated pins, means each coactive with a corresponding one of said sidewalls and pivotal relative thereto comprising symmetrical pivot means symmetrically disposed relative to said sidewalls for each pivotally and removably mounting a corresponding holder independently for pivotal movement of the holders relative to a respective sidewall, locking means comprising a part of said pivot means and each mounted pivotally on a corresponding holder and having symmetrical cross sections disposed symmetrically relative to the sidewalls and relative to said holders for each independently releasably locking a corresponding holder for pivotal movement on a corresponding one of said pivot means and operable to an unlocked position for allowing removal of the corresponding holder from the corresponding pivot means, whereby the holders can be alternatively released to allow pivotal movement relative to a corresponding pivot means and removal therefrom alternatively and independently for opening and closing the binder and each locking means having a corresponding spring biasing it to a locking position on a corresponding sidewall and allowing movement thereof to an unlocked position for removal of the corresponding holder and return thereof to a corresponding sidewall.

2. A binder for filing papers, publications, letters, catalogues and the like according to claim 1, in which said pivot means pivotally and removably mounting said holders comprises pivots on said sidewalls and said locking means.

* * * * *